US011496837B1

(12) United States Patent
Chen

(10) Patent No.: US 11,496,837 B1
(45) Date of Patent: Nov. 8, 2022

(54) LOW DISTORTION FLAT DIAPHRAGM

(71) Applicant: Gang Chen, Fujian Province (CN)

(72) Inventor: Gang Chen, Fujian Province (CN)

( * ) Notice: Subject to any disclaimer, the term of this patent is extended or adjusted under 35 U.S.C. 154(b) by 0 days.

(21) Appl. No.: 17/469,871

(22) Filed: Sep. 8, 2021

(51) Int. Cl.
*H04R 7/04* (2006.01)

(52) U.S. Cl.
CPC ..... *H04R 7/04* (2013.01)

(58) Field of Classification Search
CPC ..... H04R 7/04
See application file for complete search history.

(56) References Cited

U.S. PATENT DOCUMENTS

2002/0057822 A1* 5/2002 Kermani ..... H04R 9/047 381/427

FOREIGN PATENT DOCUMENTS

CN 212463506 U * 2/2021

* cited by examiner

*Primary Examiner* — Sunita Joshi

(57) ABSTRACT

A low distortion flat diaphragm provided with a diaphragm. A periphery of the diaphragm is defined as a fixing region and a middle portion thereof is defined as a vibrating region. The diaphragm is provided with an electric transduction coil located in the vibrating region, and a coil terminal and coil locating and wiring located in the fixing region. The diaphragm is further provided with a mass balancing line that makes a mass center of the vibrating region be matched with a mechanical center. The diaphragm is further provided with two brim compliant balancing lines. The brim compliant balancing lines and fan-out lines are symmetrically arranged in an X shape relative to a center axis of the diaphragm. The utility model eliminates cutting oscillation and sound distortion generated by unbalanced distribution of mass of the diaphragm effectively in a locating and wiring way of improving the electric transduction coil.

4 Claims, 5 Drawing Sheets

LOW DISTORTION FLAT DIAPHRAGM

BACKGROUND OF THE INVENTION

The utility model relates to the electroacoustic technical field, and in particular discloses a low distortion flat diaphragm.

In the electroacoustic technical field, a flat loudspeaker (also referred as to an isomagnetic loudspeaker) gains its name due to an adopted transduction structure. A flat vibrating diaphragm is provided with an annular bracket and a flat diaphragm compounded on the bracket. The periphery of the flat diaphragm is defined as a fixing region combined with the bracket and the middle portion thereof is defined as a vibrating region where the electrical transduction coil is arranged. The flat vibrating diaphragm is placed in a magnetic field. After the audio signal is connected to the electrical transduction coil, the electrical transduction coil drives the flat diaphragm to move synchronously in the magnetic field as the audio signal changes, such that air is vibrated to generate a sound.

As far as the flat diaphragm is concerned, the locating and wiring design of the electrical transduction coil decides mass distribution of the flat diaphragm. It is found by researches by the applicant that as the mass center of the conventional flat diaphragm is not matched with the mechanical center, cutting oscillation will be generated as a result of unbalanced distribution of the vibrating mass. In addition, in the conventional flat diaphragm, locating and wiring of the electric transduction coil is designed to direct bestride the fixing region and the vibrating region to lead to too high rigidity of the fixing region and the vibrating region, thereby aggravating sound distortion of the flat vibrating diaphragm.

In the background, it is needed to develop a novel flat diaphragm to meet a requirement of lower sound distortion.

BRIEF SUMMARY OF THE INVENTION

The utility model aims to provide a low distortion flat diaphragm which is expected to eliminate cutting oscillation and sound distortion generated by unbalanced distribution of mass of the diaphragm effectively in a locating and wiring way of improving the electric transduction coil.

In order to realize the object, the utility model provides a technical scheme as follows.

A low distortion flat diaphragm is provided with a diaphragm; a periphery of the diaphragm is defined as a fixing region and a middle portion thereof is defined as a vibrating region; the diaphragm is provided with an electric transduction coil located in the vibrating region, and a coil terminal and coil locating and wiring located in the fixing region; an sound signal is connected to the electric transduction coil via a coil terminal, and the electric transduction coil builds a coil loop via coil locating and wiring; and the diaphragm is further provided with a mass balancing line that makes a mass center of the vibrating region be matched with a mechanical center.

Further, in the technical scheme, two ends of the electrical transduction coil are respectively provides fan-out lines, each of the fan-out lines is provided with a plurality of fan-out leads that are same in quantity, are narrow in linewidth and are diffused to the fixing region in a fan shape, and two ends of the electrical transduction coil are connected with the coil terminal and the coil locating and wiring via the fan-out leads in the fan-out line.

Further, in the technical scheme, the diaphragm is further provides with two brim compliant balancing lines, and the brim compliant balancing lines and fan-out lines are symmetrically arranged in an X shape relative to a center axis of the diaphragm; each of the two brim compliant balancing lines is provided with a plurality of narrow linewidth compliant leads that are same with the fan-out leads in each of the fan-out lines in quantity, and the compliant lead in each of the brim compliant balancing lines is diffused to the fixing region in a fan shape from the vibrating region.

Optionally, in the technical scheme, a contour of the diaphragm includes, but not limited to, round and rectangular central symmetrical patterns.

Optionally, in the technical scheme, each coil conductor of the electrical transduction coil is connected with one or more than two fan-out leads on an end portion.

Optionally, in the technical scheme, at least one of the brim compliant balancing lines is electrically fused with the electrical transduction coil by way of forming the compliant leads to the coil terminal.

Compared with the prior art, the utility model has the following beneficial effects:

(1) the mass center of the vibrating region is highly matched with the mechanical center by the mass balancing line on the diaphragm, such that cutting oscillation due to unbalanced distribution of mass is reduced and distortion is reduced;

(2) rigidity enhancement of the fan-out leads to the brim region of the diaphragm is reduced and the low-frequency dive is enhanced as the fan-out lines of the electrical transduction coil employ a narrow linewidth diffusing fan-out locating and wiring manner;

(3) the brim compliant balancing lines are matched with the fan-out lines to improve the compliant consistence at the brims in the periphery, such that the resonant frequency of the diaphragm is further reduced and the low frequency performance is enhanced.

Further description of the utility model will be made below in combination with drawings and specific embodiments.

DETAILED DESCRIPTION OF THE INVENTION

Figure 1:
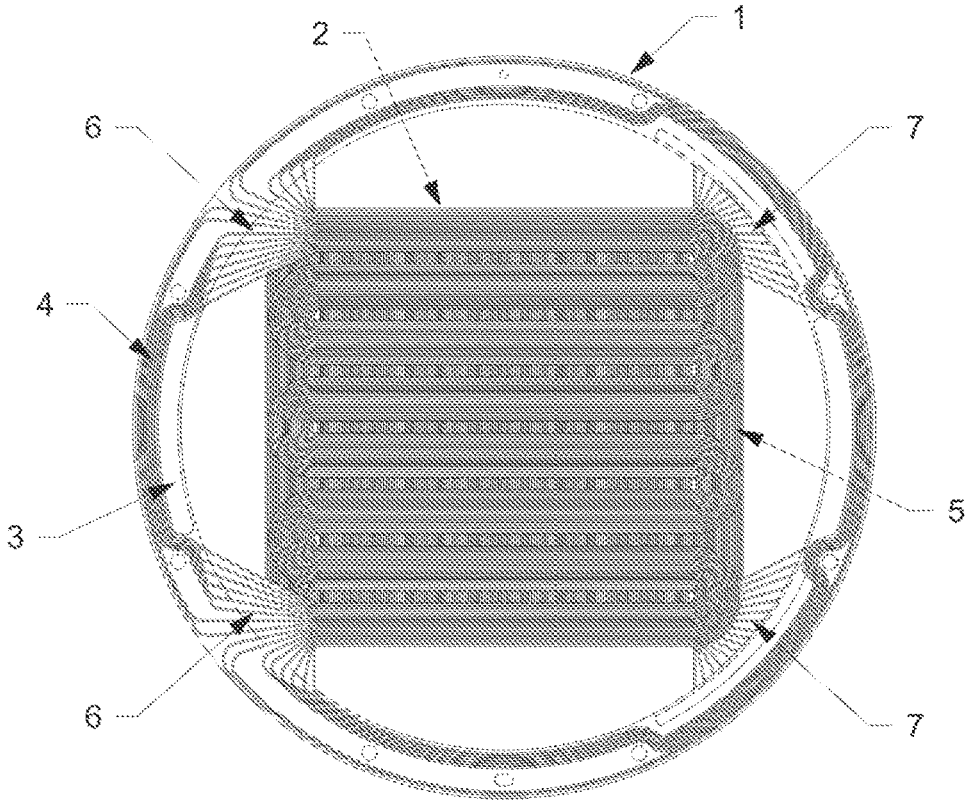
FIG. 1 is a structural schematic diagram of an embodiment I of the utility model.
Figure 2:
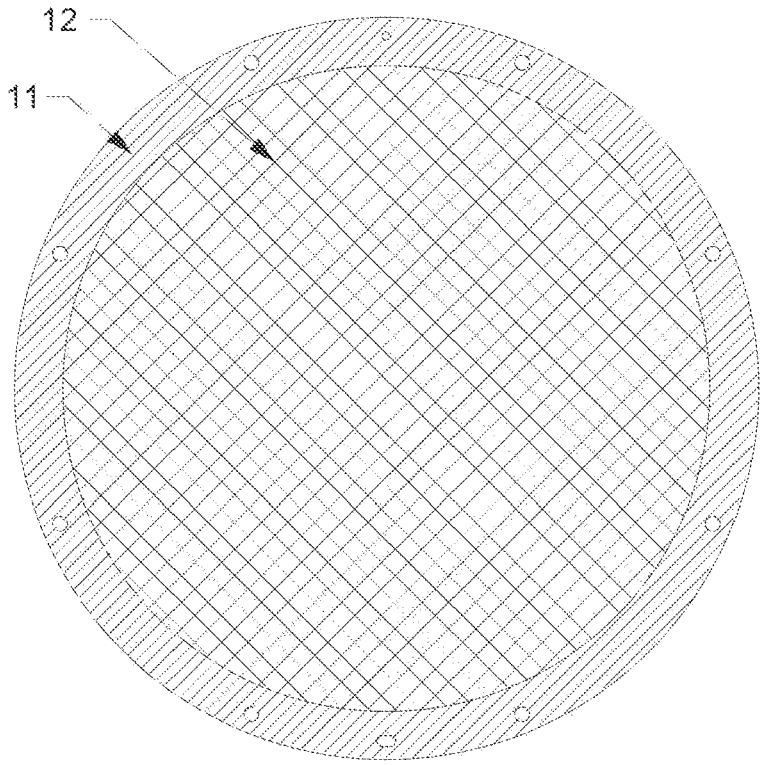
FIG. 2 is a structural schematic diagram of a diaphragm in an embodiment I of the utility model.
Figure 3:
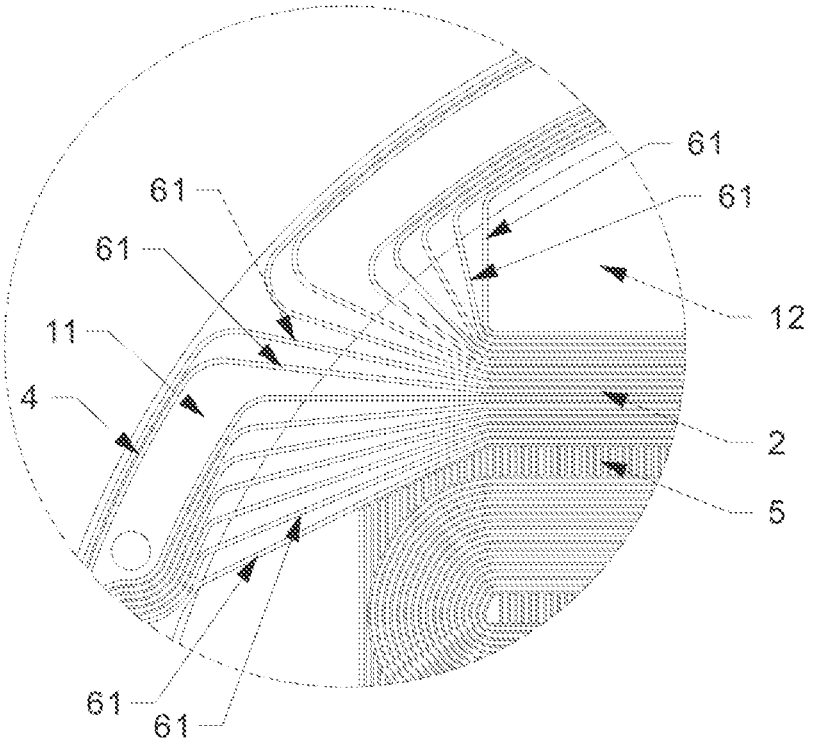
FIG. 3 is a structural schematic diagram of a fan-out line in an embodiment I of the utility model.
Figure 4:
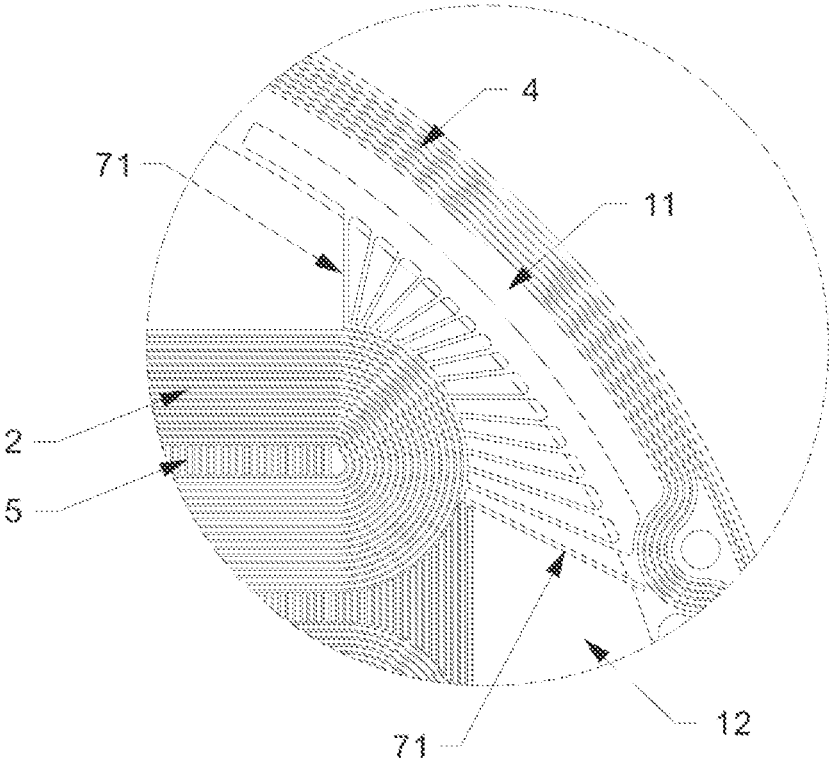
FIG. 4 is a structural schematic diagram of a brim compliant balancing line in an embodiment I of the utility model.

As shown in FIG. 1 to FIG. 8, the utility model provides a low distortion flat diaphragm. The low distortion flat diaphragm is provided with a diaphragm 1; a periphery of the diaphragm 1 is defined as a fixing region 11 and a middle portion thereof is defined as a vibrating region 12; the diaphragm 1 is provided with an electric transduction coil 2 located in the vibrating region 12, and a coil terminal 3 and coil locating and wiring 4 located in the fixing region 11; an sound signal is connected to the electric transduction coil via a coil terminal 3, and the electric transduction coil 2 builds a coil loop via coil locating and wiring 4; and the diaphragm 1 is further provided with a mass balancing line 5 that makes a mass center of the vibrating region 12 be matched with a mechanical center.

Two ends of the electrical transduction coil 2 are respectively provides fan-out lines 6, each of the fan-out lines 6 is provided with a plurality of fan-out leads 61 that are same in quantity, are narrow in linewidth and are diffused to the fixing region 11 in a fan shape, and two ends of the electrical transduction coil 2 are connected with the coil terminal 3 and the coil locating and wiring 4 via the fan-out leads 61 in the fan-out line 6.

The diaphragm 1 is further provides with two brim compliant balancing lines 7, and the brim compliant balancing lines 7 and fan-out lines 6 are symmetrically arranged in an X shape relative to a center axis of the diaphragm 1; each of the two brim compliant balancing lines 7 is provided with a plurality of narrow linewidth compliant leads 71 that are same with the fan-out leads 61 in each of the fan-out lines 6 in quantity, and the compliant lead 71 in each of the brim compliant balancing lines 7 is diffused to the fixing region 11 in a fan shape from the vibrating region 12.

Exemplarily, the low distortion flat diaphragm 1 provided by the utility model may adopt the following embodiments.

Example 1

As shown in FIG. 1 to FIG. 4, in the embodiment, the contour of the diaphragm 1 is round.

In the embodiment, the electrical transduction coil 2, the coil terminal 3 and the coil locating and wiring 4 are designed on the diaphragm 1, and the fan-out leads 61 of the fan-out line 6 are adjusted to be diffused to the fixing region 11 in a fan shape from the vibrating region 12; the brim compliant balancing lines 7 are designed on the diaphragm 1, the brim compliant balancing lines 7 and fan-out lines 6 are symmetrically arranged in an X shape relative to a center axis of the diaphragm 1; and with reference to the magnetic field configured by the flat vibrating diaphragm, the mass balancing line 5 on the diaphragm 1 is designed according to a dimension of a magnetic path.

In the embodiment, the coil conductor of the electrical transduction coil 2 is designed with narrow linewidth, such that each coil conductor of the electrical transduction coil is connected with one fan-out lead 61 on an end portion. As the coil conductor and the fan-out leads 61 are designed with narrow linewidth, the rigidity of the boundary brim of the fixing region 11 and the vibrating region 12 of the diaphragm 1 is not enhanced.

Example II

As shown in FIG. 5 to FIG. 8, in the embodiment, the contour of the diaphragm 1 is rectangular.

In the embodiment, the electrical transduction coil 2, the coil terminal 3 and the coil locating and wiring 4 are designed on the diaphragm 1, and the fan-out leads 61 of the fan-out line 6 are adjusted to be diffused to the fixing region 11 in a fan shape from the vibrating region 12; the brim compliant balancing lines 7 are designed on the diaphragm 1, the brim compliant balancing lines 7 and fan-out lines 6 are symmetrically arranged in an X shape relative to a center axis of the diaphragm 1; and with reference to the magnetic field configured by the flat vibrating diaphragm, the mass balancing line 5 on the diaphragm 1 is designed according to a dimension of a magnetic path.

In the embodiment, the coil conductor of the electrical transduction coil 2 is designed with narrow linewidth. If each coil conductor of the electrical transduction coil is connected with one fan-out lead 61 on an end portion by means of settings of the embodiment I, the rigidity of the boundary brim of the fixing region 11 and the vibrating region 12 of the diaphragm 1 will be enhanced. Thus, in the embodiment, each coil conductor of the electrical transduction coil 2 is cut and diffused with narrow linewidth on the end portion and is connected with one fan-out lead 61, such that the rigidity of the boundary brim of the fixing region 11 and the vibrating region 12 of the diaphragm 1 will not be enhanced.

Figure 5:
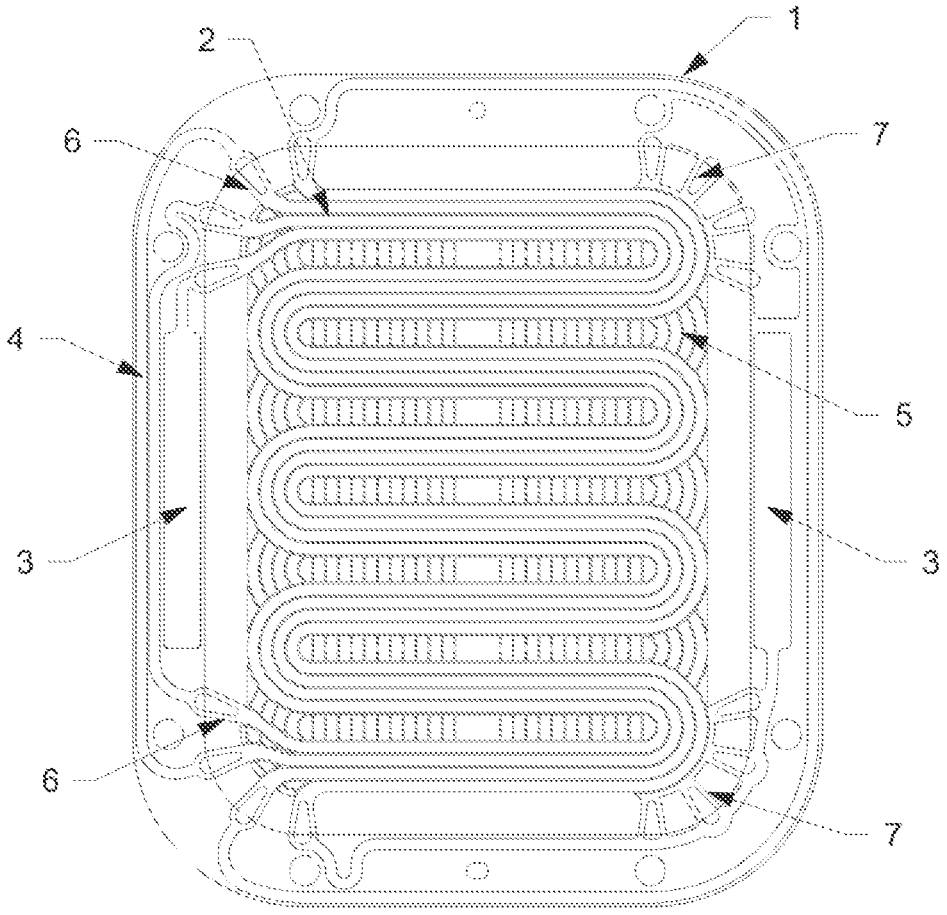
FIG. 5 is a structural schematic diagram of an embodiment II of the utility model.
Figure 6:
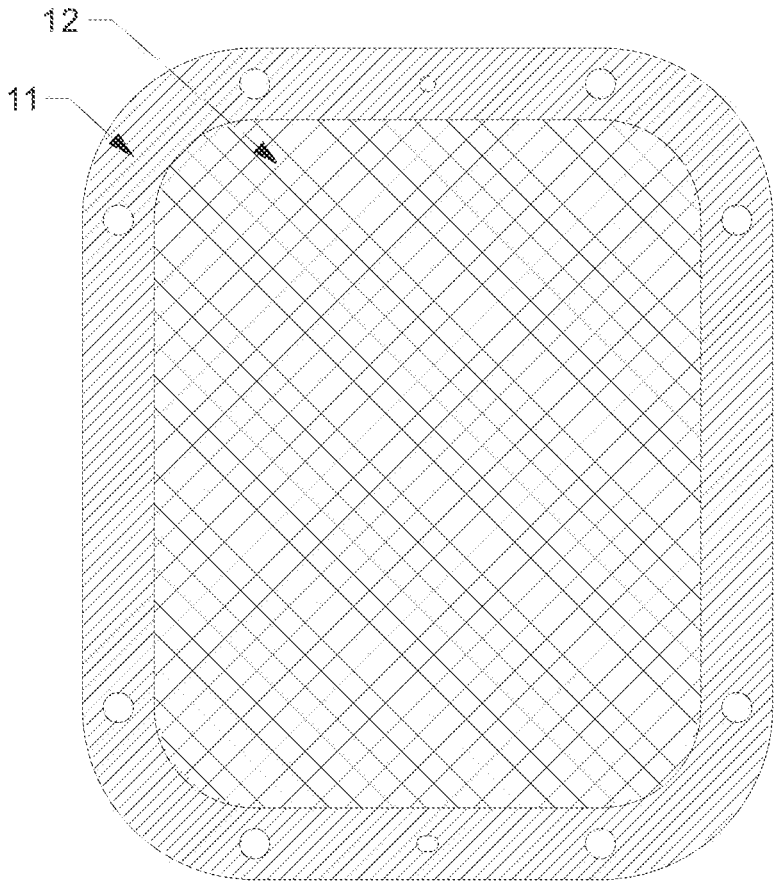
FIG. 6 is a structural schematic diagram of a diaphragm in an embodiment II of the utility model.
Figure 7:
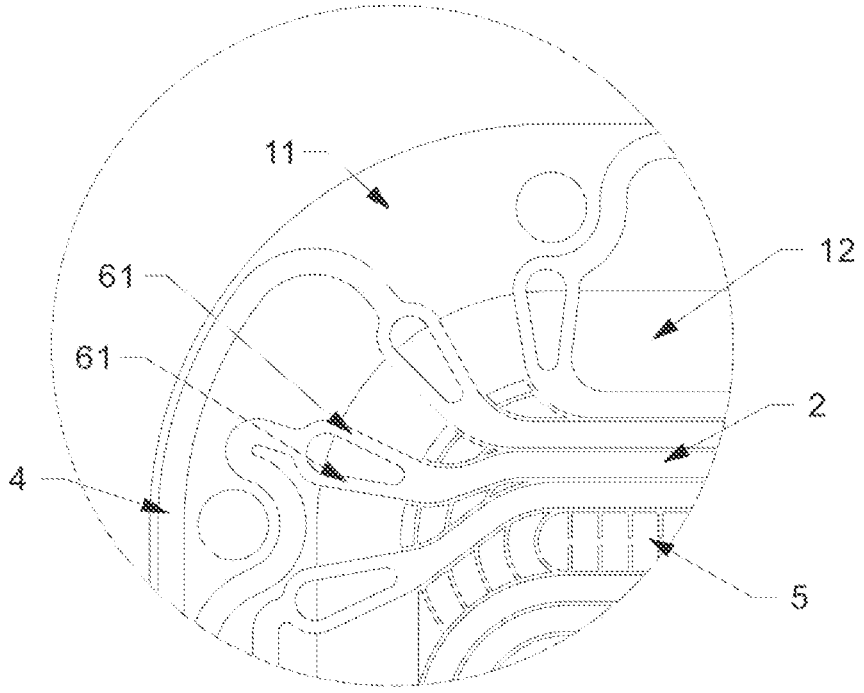
FIG. 7 is a structural schematic diagram of a fan-out line in an embodiment I of the utility model.
Figure 8:
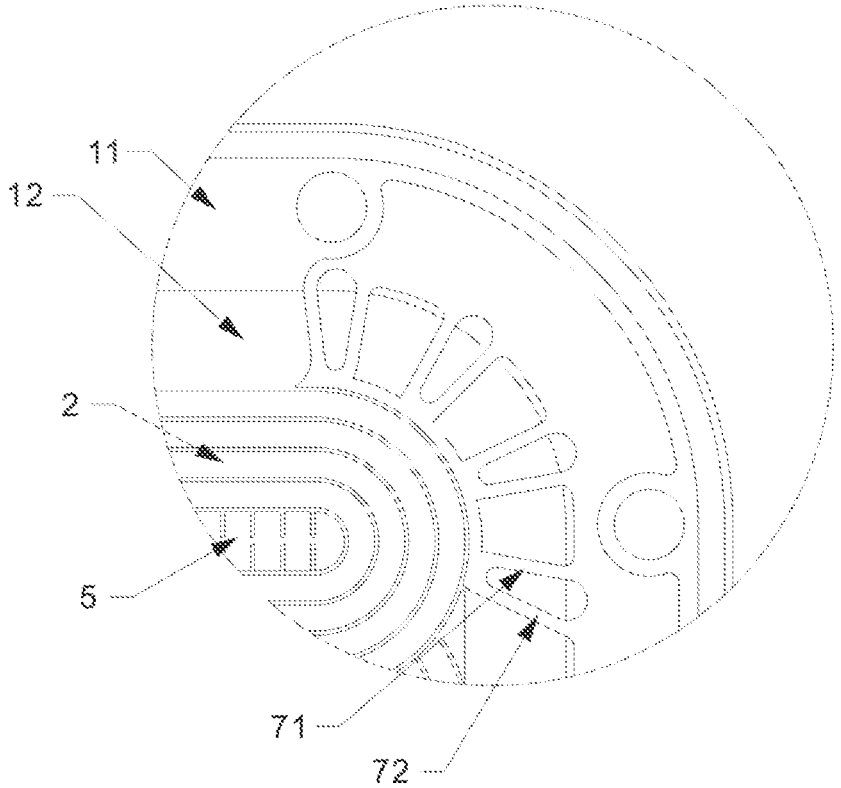
FIG. 8 is a structural schematic diagram of a brim compliant balancing line in an embodiment I of the utility model.

In the embodiment, as the fixing region 11 of the diaphragm 1 is designed relatively narrow, at least one of the brim compliant balancing lines is electrically fused with the electrical transduction coil 2 by way of forming the compliant leads 71 to the coil terminal 3, thereby reducing the design difficulty of the line. As shown in FIG. 5, in the embodiment, the brim compliant balancing line 7 located on the lower side is electrically fused with the electrical transduction coil 2 by way of forming the compliant leads 71 to the coil terminal 3.

For those skilled in the art, the protection scope of the utility model is not limited to details of the above exemplary embodiments. All changed embodiments with equal meaning within the protection scope made by those skilled in the art based on elements of the utility model shall be included in the utility model without departing the spring or essential characteristics of the utility model.

What is claimed is:

1. A low distortion flat diaphragm, wherein the low distortion flat diaphragm is provided with a diaphragm; a periphery of the diaphragm is defined as a fixing region and a middle portion thereof is defined as a vibrating region; the diaphragm is provided with an electric transduction coil located in the vibrating region, and a coil terminal and coil locating and wiring located in the fixing region; a sound signal is connected to the electric transduction coil via a coil terminal, and the electric transduction coil builds a coil loop via coil locating and wiring; and the diaphragm is further provided with a mass balancing line that makes a mass center of the vibrating region be matched with a mechanical center;

two ends of the electrical transduction coil are respectively provides fan-out lines, each of the fan-out lines is provided with a plurality of fan-out leads that are same in quantity, are narrow in linewidth and are diffused to the fixing region in a fan shape, and two ends of the electrical transduction coil are connected with the coil terminal and the coil locating and wiring via the fan-out leads in the fan-out line;

the diaphragm is further provides with two brim compliant balancing lines, and the brim compliant balancing lines and fan-out lines are symmetrically arranged in an X shape relative to a center axis of the diaphragm; each of the two brim compliant balancing lines is provided with a plurality of narrow linewidth compliant leads that are same with the fan-out leads in each of the fan-out lines in quantity, and the compliant lead in each of the brim compliant balancing lines is diffused to the fixing region in a fan shape from the vibrating region.

2. The low distortion flat diaphragm according to claim 1, wherein a contour of the diaphragm comprises round and rectangular central symmetrical patterns.

3. The low distortion flat diaphragm according to claim 1, wherein each coil conductor of the electrical transduction coil is connected with one or more than two fan-out leads on an end portion.

4. The low distortion flat diaphragm according to claim 1, wherein at least one of the brim compliant balancing lines is electrically fused with the electrical transduction coil by way of forming the compliant leads to the coil terminal.

* * * * *